US012606350B2

(12) United States Patent
Gatti

(10) Patent No.: US 12,606,350 B2
(45) Date of Patent: Apr. 21, 2026

(54) CLOSURE DEVICE FOR A CONTAINER FOR LIQUIDS

(71) Applicant: Artsana S.p.A., Grandate (IT)

(72) Inventor: Francesco Gatti, Villa Guardia (IT)

(73) Assignee: Artsana S.p.A., Grandate (IT)

( * ) Notice: Subject to any disclaimer, the term of this patent is extended or adjusted under 35 U.S.C. 154(b) by 0 days.

(21) Appl. No.: 18/773,815

(22) Filed: Jul. 16, 2024

(65) Prior Publication Data

US 2025/0026540 A1 Jan. 23, 2025

(30) Foreign Application Priority Data

Jul. 20, 2023 (IT) ..... 102023000015297

(51) Int. Cl.
*B65D 41/04* (2006.01)
*A47G 19/22* (2006.01)
*B65D 47/20* (2006.01)

(52) U.S. Cl.
CPC ..... *B65D 41/0485* (2013.01); *A47G 19/2272* (2013.01); *B65D 41/0492* (2013.01); *B65D 47/2018* (2013.01)

(58) Field of Classification Search
CPC ..... B65D 2517/0049; B65D 77/20; B65D 41/0485; B65D 41/0492; B65D 47/2018; B65D 47/24; B65D 51/165; B65D 47/06; B65D 53/00; A47G 19/2272
See application file for complete search history.

(56) References Cited

U.S. PATENT DOCUMENTS 4,917,267 A * 4/1990 Laverdure ..... B65D 1/0238 222/541.6
2008/0167605 A1* 7/2008 Torvik ..... A61M 1/06 604/74
2011/0186573 A1* 8/2011 Tardif ..... B65D 41/02 220/260
2020/0229625 A1* 7/2020 Holschumacher ..... A47G 19/2272

FOREIGN PATENT DOCUMENTS

EP 1632437 3/2006

OTHER PUBLICATIONS

Italian search report dated Jan. 31, 2024; Application No. 102023000015297; 10 pages.

* cited by examiner

*Primary Examiner* — Kareen K Thomas
(74) *Attorney, Agent, or Firm* — RANKIN, HILL & CLARK LLP; Erik J. Overberger

(57) ABSTRACT

Closure device for a container for liquids, comprising an elastically deformable membrane, having a main body, which can be placed to close an opening of a container. The membrane comprises a connection portion, an impervious main wall protruding from the connection portion and a free edge which is elastically deformable in the presence of an external suction action. The membrane also has a lower body projecting from the connection portion and comprising a plurality of openings for the passage of liquids and a retaining flange engageable with an edge of the container. The membrane is configured to switch between a resting configuration and a working configuration, in which the free edge of the main body is respectively spaced apart and close to the retaining flange of the lower body.

12 Claims, 4 Drawing Sheets

CLOSURE DEVICE FOR A CONTAINER FOR LIQUIDS

TECHNICAL FIELD

The present disclosure relates to a closure device for containers adapted to contain liquids. Such a device finds particular application in the field related to the closures of containers for learning, including, for example, glasses or cups, intended for use by children or persons with disabilities, to avoid creating splashes of the liquid contained in the container during use or during situations in which the container might be shaken.

DESCRIPTION OF THE PRIOR ART

In the state of the art, closure devices for liquid containers are known that allow drinking from the container without causing splashing and without the need to remove and reapply hard-to-use caps.

An example of a closure device is disclosed in document EP 2265152 A1. In particular, such a closure device comprises a gasket adapted to abut an edge of a valve element, and a splash guard having a central cavity adapted to receive and constrain to the gasket.

The document GB 2461005 A shows a further example of a device for drinking from a container capable of preventing the formation of splashes. In particular, such a device comprises a support element, a gasket insertable in the support element and a retaining element adapted to retain the gasket in place against the support element.

Further closure devices are disclosed in the prior art document EP 3934488 A1, in which a gasket and a closure body for accommodating the gasket are shown. In particular, the closure body comprises passages for liquids and a portion adapted to abut with a lip of the gasket to allow the retention thereof.

A further example of a closure device is shown in the prior art document EP 1632437 A1, in which a tubular portion is movable with respect to a fixed portion to switch between an opening configuration and a closing configuration, respectively to allow and block the exit of liquids.

Problem of the Prior Art

The known closure devices require moulding different components having elaborate shapes, and therefore difficult to manufacture, necessary to carry out all the functions necessary to allow a child or a person with a disability to drink from the container, avoiding the exit of splashes and simultaneously ensuring a good seal between the device and the container.

SUMMARY OF THE DISCLOSURE

In this context, the technical task underlying the present disclosure is to propose a closure device for containers for liquids which allows to overcome the drawbacks of the prior art mentioned above.

In particular, the object of the present disclosure is to provide a closure device for containers which is simplified and easy to manufacture and assemble by the user, without losing functionality, so that a child or a person with a disability can drink from the container without causing unwanted spills of liquid or without the need to screw and unscrew caps every time it is used.

A further object of the present disclosure is to find an alternative solution to the solutions of the state of the art, which allows to make it easier to clean the components.

The technical task indicated above, and the specified objects are achieved by a device for a container for liquids having the characteristics set out in one or more of the appended claims.

Advantages of the Disclosure

The present disclosure has the advantage of obtaining, in a simple and effective manner, a closure device consisting of simple geometric shapes, easily reproducible and lacking portions or recesses which are difficult to access. In particular, the closure device of the present disclosure comprises a membrane adapted to elastically deform to pass between a resting configuration and a working configuration. It is thereby possible to make the device in a resting configuration, easy to obtain, and to use the device in the working configuration, which would be difficult to obtain with the same production technique.

Advantageously, the closure device of the present disclosure allows to unify the main functions of a closure device in the membrane, greatly reducing the structural and production complexity.

The present disclosure has the further advantage of allowing an adequate and practical cleaning of the components. In fact, in the resting configuration the membrane can be disengaged from the container and, thanks to the simple geometry lacking narrow recesses, it can be adequately cleaned.

BRIEF DESCRIPTION OF THE DRAWINGS

Further features and advantages of the present disclosure will become more apparent from the indicative and thus non-limiting description of a preferred but non-exclusive embodiment of a closure device, as illustrated in the appended drawings, in which.

DETAILED DESCRIPTION

Figure 1:
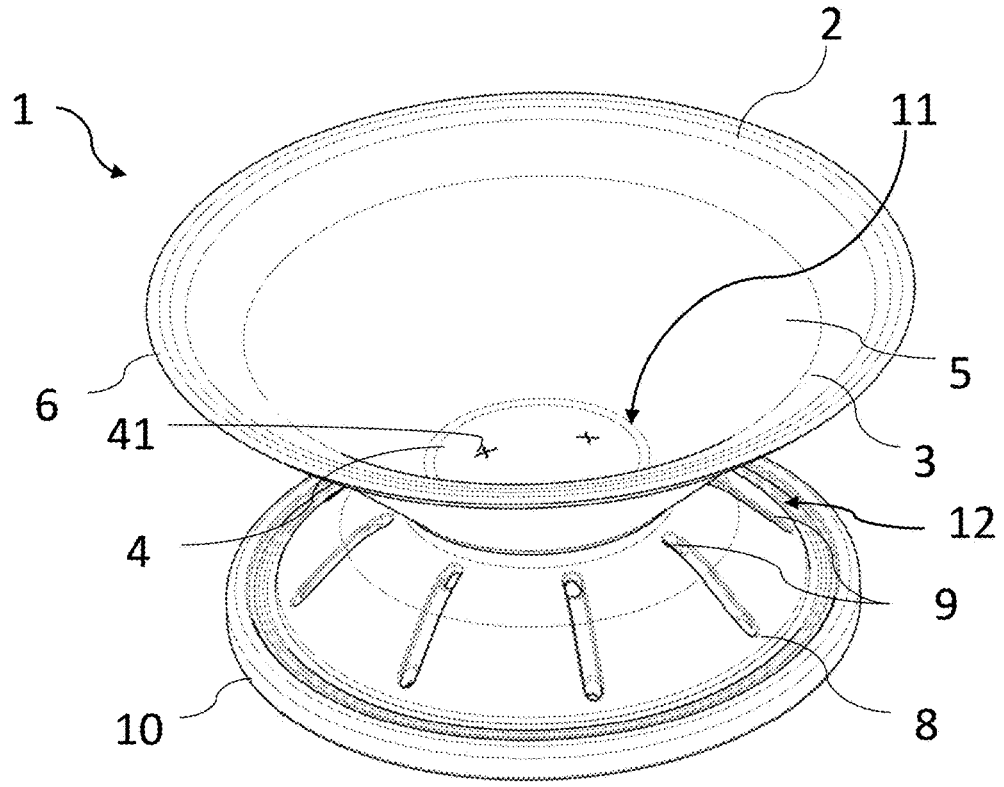
FIG. 1 shows a top perspective view of a closure device according to the present disclosure in a first configuration.
Figure 2:
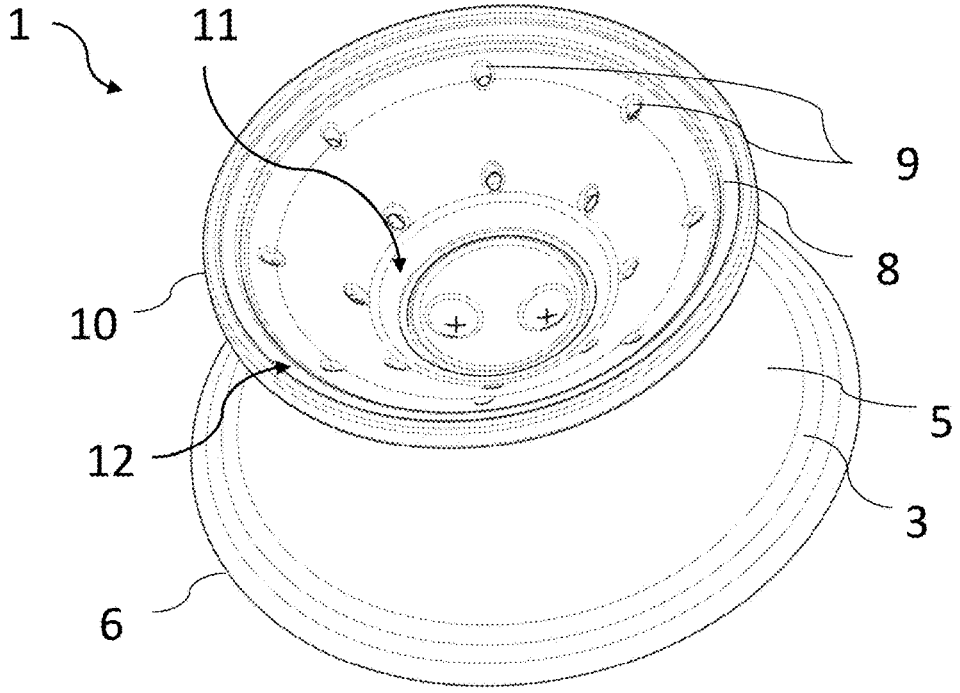
FIG. 2 shows a bottom perspective view of a closure device according to FIG. 1 in the first configuration.
Figure 3:
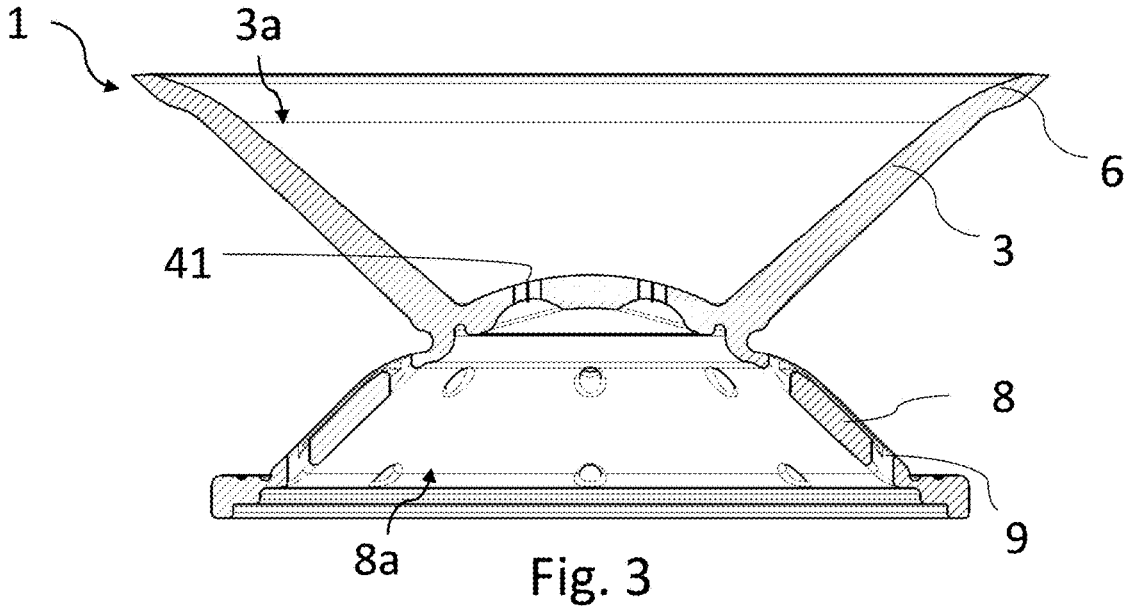
FIG. 3 shows a sectional view of the closure device according to the present disclosure in the first configuration.

With reference to the attached figures, a closure device for a container for liquids is denoted with 1. Instead, 100 indicates the container 100 for liquids, and in particular a container for drinking liquids, which comprises an opening 105 delimited by an opening edge 110.

The device 1 of the present disclosure comprises an elastically deformable membrane 2, which has a main body 3 adapted to be placed to close the opening 105 of the container 100.

The main body 3 of the membrane 2 comprises a connection portion 4 and an impervious main wall 5, protruding from the connection wall 4 and has a free edge 6 opposite the connection portion 4.

According to the preferred embodiment of the disclosure, the connection portion 4 has one or more openings 41 to allow the passage of air between an environment inside the container and an environment outside it. It should be noted that such openings do not allow the passage of liquids. For example, the openings 41 can be shaped as notches in the connection portion 4. Accordingly, the main body 3 as a whole is preferably impervious with respect to liquids.

The membrane 2 further has a lower body 8 projecting from the connection portion 4 of the main body 3 and comprising a retention flange 10 adapted to engage with the opening edge 110 of the container 100 to constrain the membrane 2 to the container 100. The lower body 8 further comprises a plurality of openings 9 for the passage of liquids. Preferably, the openings 9 have a circular or oval shape. Still preferably, the openings 9 are arranged uniformly on the lower body 8. In particular, the openings 9 can be circumferentially distributed along the lower body 8, and optionally some openings 9 can be radially spaced from each other. Still preferably, the lower body 8 has a plurality of grooves, for example radial grooves, in which one or more openings 9 are positioned.

Figure 4:
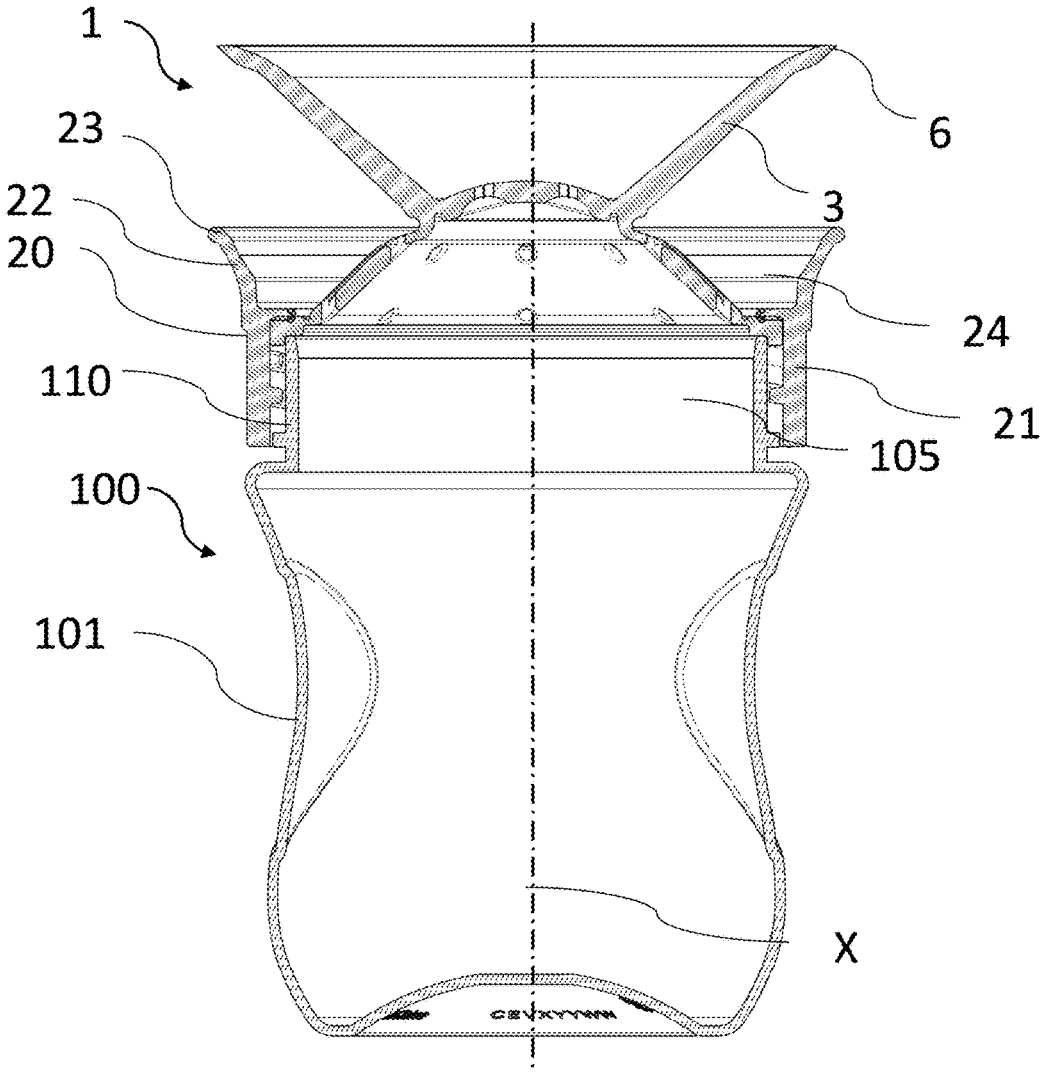
FIG. 4 shows a sectional view of a cup-shaped container provided with the device according to the disclosure in the first configuration.
Figure 5:
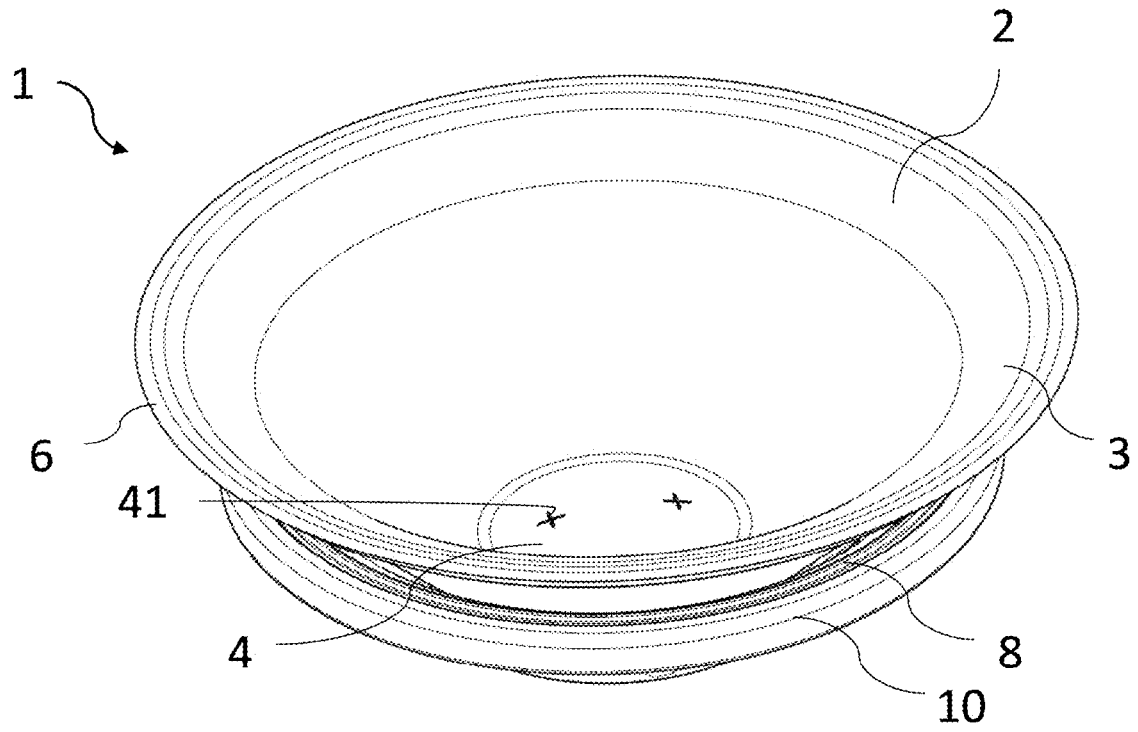
FIG. 5 shows a top perspective view of a closure device according to the present disclosure in a second configuration.
Figure 6:
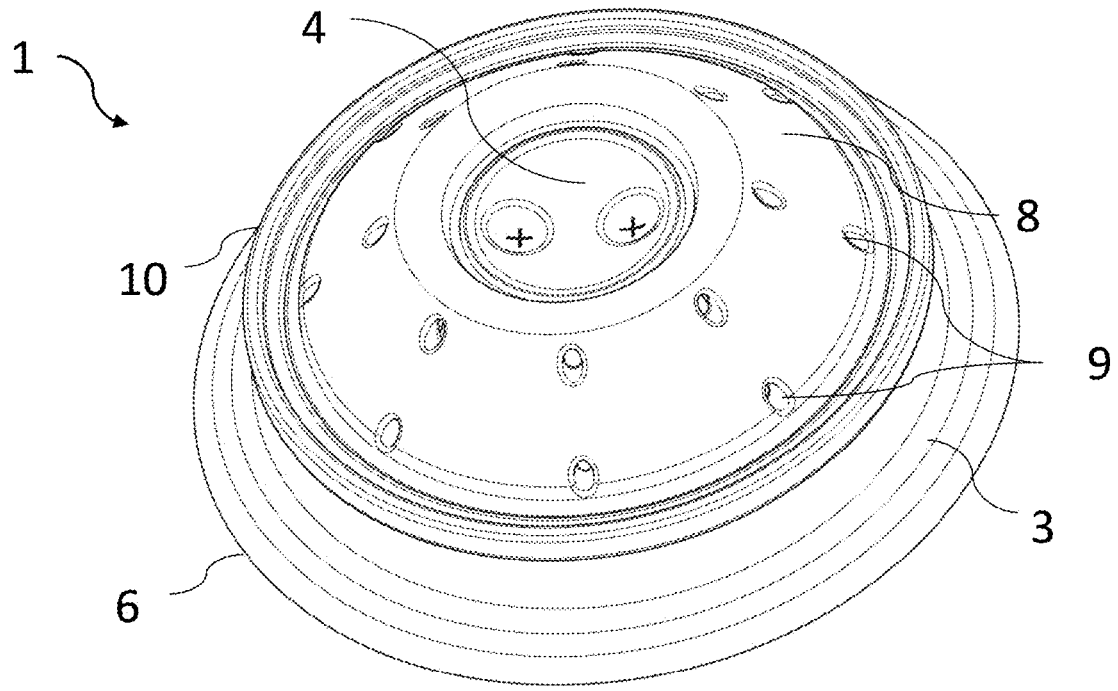
FIG. 6 shows a bottom perspective view of a closure device according to FIG. 5 in the second configuration.
Figure 8:
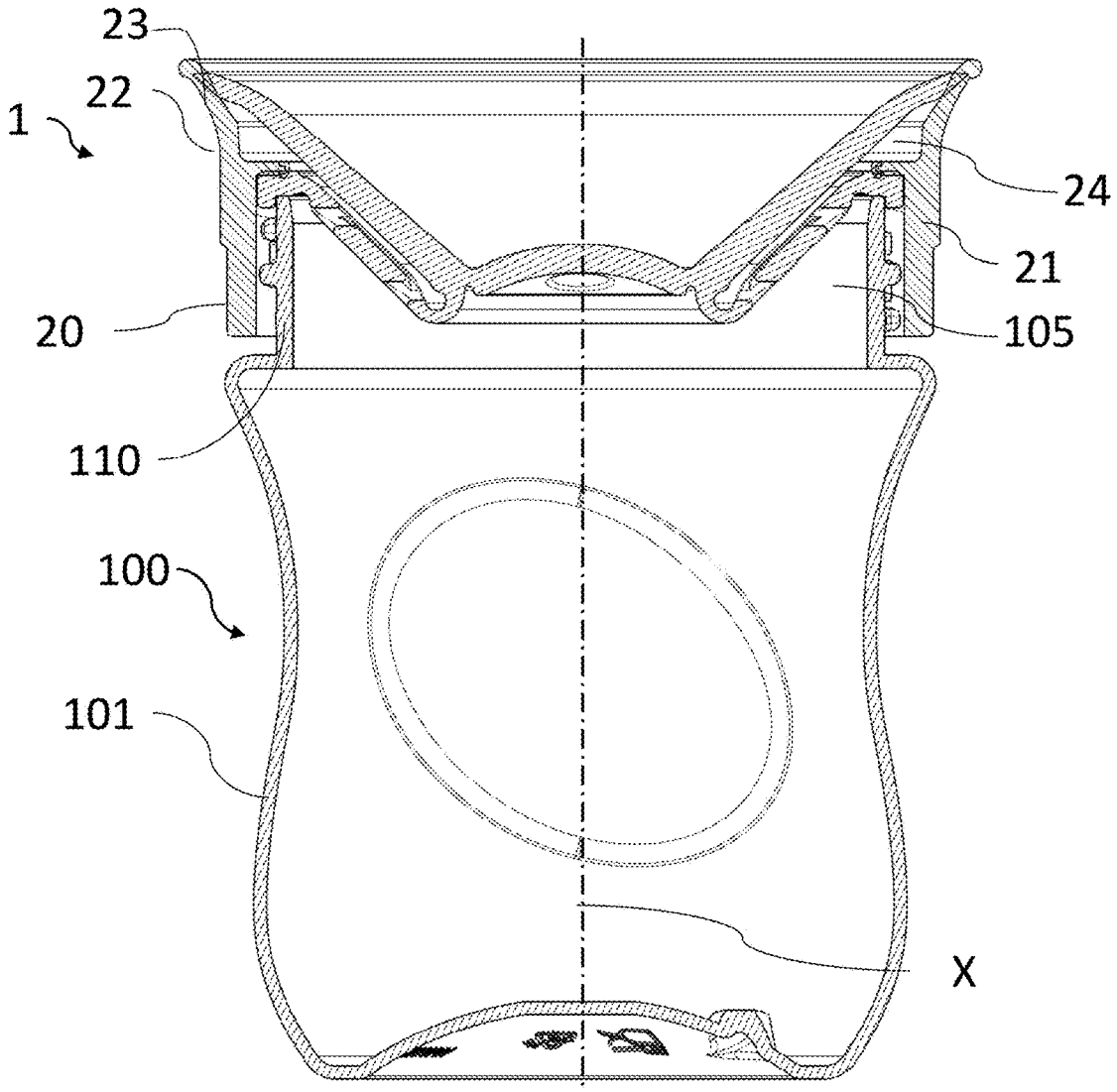
FIG. 8 shows a sectional view of a cup-shaped container provided with the device according to the disclosure in the second configuration.

According to an embodiment of the disclosure, shown in FIGS. 4 and 8, the device 1 comprises a collar 20 couplable to the container 100. It should be noted that the collar 20 is disclosed as a component of the device 1, but it can also be understood as a component of the container 100.

Preferably, the collar 20 comprises a side wall 21 delimiting a cavity 24 adapted to receive the membrane 2. Still preferably, the collar 20 comprises an end portion 22 having an upper edge 23.

According to a preferred aspect of the disclosure, the side wall 21 of the collar 20 is adapted to retain the retaining flange 10 against the edge 110 of the container 100 and, more preferably, to retain the retaining flange 10 between the edge 110 of the container 100 and the side wall 21 itself.

Preferably, the side wall 21 has a thread adapted to couple with a respective thread of the edge 110 of the container 100. The retaining flange 10 is adapted to be inserted between the thread and the upper edge 23 of the collar 20.

Still preferably, the free edge 6 of the membrane 2 is adapted to abut with the end portion 22 of the collar 20 and, more preferably, with the upper edge 23 of the end portion 22.

The free edge 6 is therefore adapted to seal the opening 105 of the container 100, engaging for example the opening edge 110 or, alternatively, the end portion 22 of the collar 20. Furthermore, the free edge 6 is configured to elastically deform, when subjected to a suction action of a user, to put an environment inside the container 100 in fluid communication with an environment outside it. In particular, the free edge 6 is configured to allow the exit of liquids passed through the openings 9 of the lower body 8. Such a deformation, of known type, involves a local lifting of the free edge 6 from the opening edge 110 and/or from the end portion 22 of the collar 20.

The membrane 2 is configured to elastically switch between a resting configuration and a working configuration. The resting configuration is functional to the construction and assembly of the membrane 2, but in such a configuration the membrane 2 is not adapted to seal the opening 105 of the container 100. In particular, in the resting configuration the free edge 6 of the membrane 2 is lifted with respect to the edge 110 of the container 100 and/or with respect to the end portion 22, and in particular with respect to the upper edge 23, of the collar 20. In the resting configuration, illustrated in FIGS. 1-4, the free edge 6 of the main body 3 is spaced from the retaining flange 10 of the lower body 8. In the working configuration, illustrated in FIGS. 5-8, the free edge 6 of the main body 3 is close to the retaining flange 10 of the lower body, so as to seal the opening 105 of the container, and/or the cavity of the collar 20, resting on the edge of the container 110 and/or on the end portion 22, and in particular on the upper edge 23, of the collar 20.

It should be noted that, for the purposes of the present description, "close to" refers to a position of the free edge 6 which is less spaced from the retaining flange 10 along a main direction X with respect to the position assumed in the resting configuration.

Preferably, the membrane 2 is configured to elastically switch from the resting configuration to the working configuration upon the receipt of a pressure at the connection portion 4 of the main body 3. Therefore, the user is capable of coupling the membrane 2 to the container 100 in the resting configuration, and then bringing the membrane from the resting configuration to the working configuration by pressing at the connection portion 4.

In accordance with the preferred embodiment of the disclosure, illustrated in the attached figures, the main body 3 and the lower body 8 of the membrane 2 each have a respective concavity 3*a*, 8*a*, which face in opposite orientations in the resting configuration and in the same orientation in the working configuration. In more detail, the main body 3 and the lower body 8 both have a concave shape, closed at the connection portion 4 and having an opening opposite the connection portion 4.

According to an embodiment of the disclosure, the main body 3 and the lower body 8 have a hollow truncoconical shape. In particular, in the resting configuration the main body 3 and the lower body 8 define an X-shape in section with the respective concavities 3*a*, 8*a* facing opposite orientations.

It should be noted that the membrane 2 of the closing device of the present disclosure has a simple and easily reproducible geometry in the resting configuration. It should therefore be noted that such a geometry allows an accurate and practical cleaning of the device and, in particular, of the membrane.

According to a preferred aspect of the disclosure, in the working configuration the main body 3 is at least partially housed in the concavity 8*a* of the lower body 8.

Preferably, the lower body 8 in the passage between the resting configuration and the working configuration is configured to elastically deform, inverting the orientation of the respective concavity 8*a* by folding at a first folding line 11 which extends between the connection portion 4 of the main body 3 and the lower body 8.

Still preferably, the membrane 2 has a second folding line 12 along the retaining flange 10 for switching between the resting configuration and the working configuration.

According to an aspect, the first folding line 11 and/or the second folding line 12 are defined by grooves comprised respectively in the connection portion 4 and/or in the retaining flange 10. Alternatively, the connection portion 4 and/or the retaining flange 10 are shaped to define weakening portions at the first 11 and/or the second folding line 12, respectively. Such weakening portions are adapted to favour the deformation of the material which constitutes the membrane 2 along the weakening portions.

Still preferably, the lower body is adapted to deform between the connection portion 4 and the retaining flange 10 to invert the orientation of the respective concavity 8*a*. Therefore, the retaining flange 10 and the connection portion 4 remain at least partly undeformed in switching between the resting configuration and the working configuration.

Figure 7:
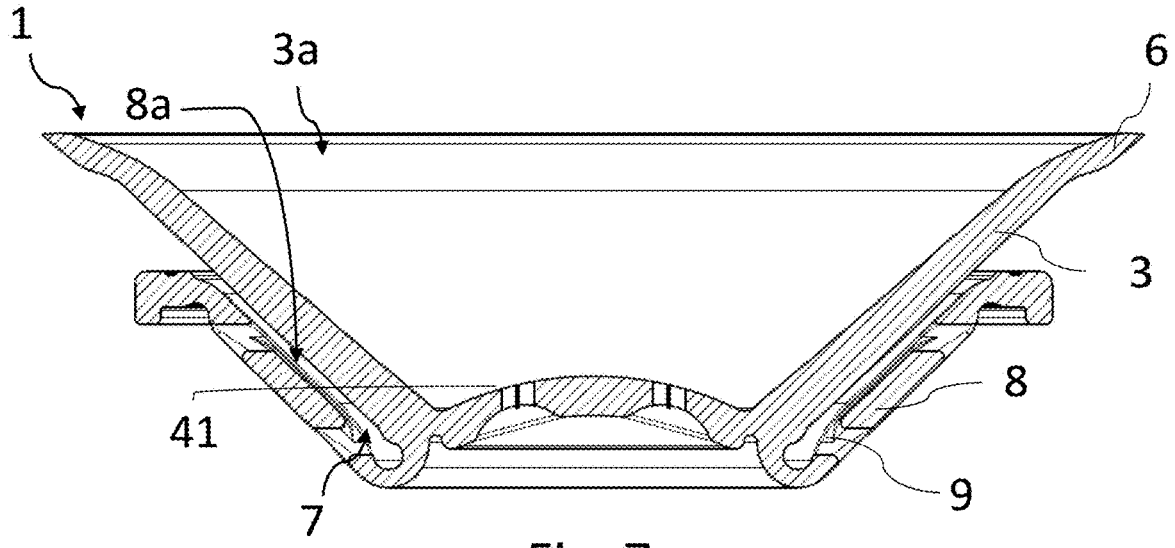
FIG. 7 shows a sectional view of the closure device according to the present disclosure in the second configuration.

According to a preferred aspect of the disclosure, illustrated in FIGS. 7 and 8, the membrane 2 in the working configuration identifies a suction chamber 7 between the main wall 5 of the main body 3 and the lower body 8. The suction chamber 7 is adapted to receive liquids from the container 100 through the plurality of openings 9 of the lower body 8 and to temporarily retain the liquids.

Furthermore, the free edge 6 in the working configuration is adapted to seal the suction chamber 7 to retain the liquids. In addition, the free edge is adapted to elastically deform when subjected to the suction action of the user to place the suction chamber 7 in fluid communication with the environment outside the container 100 and thus allow the exit of liquid from the suction chamber 7.

According to the preferred embodiment of the disclosure, illustrated in FIGS. 4 and 8, the suction chamber 7 is identified between the main wall 5 of the main body 3, the lower body 8 and the side wall 21 of the collar 20.

According to the preferred embodiment of the disclosure, the membrane 2 is made in a single piece. Preferably, the membrane 2 can be made by moulding, preferably injection moulding, in particular when in the resting configuration. Instead, in the preferred embodiments, the shape of the membrane 2 in the working configuration would not allow its moulding.

According to an embodiment of the disclosure, not illustrated, the membrane 2 can be made overmolded to the collar.

Preferably, the membrane 2 is made of polymeric material and, more preferably, of silicone.

Advantageously, the membrane 2 has a shape which is optimised and simple to make, defined by simple geometric figures obtainable by moulding. It is thereby possible to speed up and simplify the membrane manufacturing process and simplify the assembly process on a container. In fact, as previously anticipated, making the membrane in a single piece according to a simple geometry makes cleaning the device more practical.

A further object of the present disclosure is a container 100 for liquids comprising a container body 101 adapted to receive liquids and having a free opening edge 110 and an opening 105 delimited by the edge 110 to allow the passage of liquids along the main direction X.

The container 100 subject-matter of the present disclosure further comprises a closure device 1 according to the present description coupled to the edge 110.

According to a preferred aspect of the disclosure, the coupling between the device 1 and the opening edge 110 of the container 100 occurs by means of reversible connection between respective threads of the collar 20 of the device 1 and the edge 110 of the container.

According to an alternative embodiment, the retaining flange 10 of the membrane 2 of the device 1 can comprise a respective seat adapted to internally receive at least in part the edge 110 of the container for coupling thereto. Alternatively, the container 100 can have a seat adapted to receive and be constrained to the retaining flange 10 of the membrane 2 of the device 1.

The invention claimed is:

1. Closure device for a container for drinking liquids, comprising:

an elastically deformable membrane which has:

a main body configured to be placed to close an opening of a container for liquids, delimited by an opening edge, the main body comprising a connection portion and an impervious main wall protruding from the connection portion, the main wall having a free edge opposite the connection portion, a lower body projecting from the connection portion of the main body and comprising a retaining flange adapted to engage with the edge of the container to constrain the membrane to the container, the lower body comprising a plurality of openings for the passage of liquids, wherein the free edge is configured to elastically deform when subjected to a suction action of a user, to put an environment inside the container in fluid communication with an environment outside it and allow liquids to exit from the openings, wherein the membrane is configured to elastically switch between a resting configuration, in which the free edge of the main body is spaced from the retaining flange of the lower body, and a working configuration, in which the free edge of the main body is close to the retaining flange of the lower body.

2. Device according to claim 1, wherein the main body and the lower body of the membrane each have a respective concavity, the concavities of the main body and of the lower body facing opposite orientations in the resting configuration and facing a same orientation in the working configuration.

3. Device according to claim 2, wherein in the working configuration the main body is at least partially housed in the concavity of the lower body.

4. Device according to claim 2, wherein the lower body, in the transition between the resting configuration and the working configuration, is configured to elastically deform, inverting the orientation of the respective concavity by folding at a first folding line which extends between the connection portion of the main body and the lower body.

5. Device according to claim 1, wherein the main body and the lower body have a hollow truncoconical shape, in the resting configuration the main body and the lower body defining an X-shape in section with the respective concavities facing opposite orientations.

6. Device according to claim 4, wherein the membrane has a second folding line along the retaining flange for switching between the resting configuration and the working configuration.

7. Device according to claim 1, wherein the membrane is configured to elastically switch from the resting configuration to the working configuration upon the receipt of a pressure at the connection portion of the main body.

8. Device according to claim 1, wherein the membrane in the working configuration identifies a suction chamber between the main wall of the main body and the lower body, adapted to receive liquids from the container through the plurality of openings, the free edge in the working configuration being adapted to seal the suction chamber and to deform in order to put the suction chamber in fluid communication with the environment outside the container when subjected to the suction action of the user.

9. Device according to claim 1, wherein the membrane is made in one piece, and can be made by means of moulding in the resting configuration.

10. Device according to claim 1, comprising a collar, couplable to the container and comprising a side wall delimiting a cavity adapted to receive the membrane, wherein the free edge of the membrane is configured to abut with an end portion of the collar.

11. Device according to claim 10, wherein the side wall of the collar is configured to retain the retaining flange against the edge of the container.

12. Container for drinking liquids comprising:

a container body adapted to receive liquids and having an upper free edge and an opening delimited by the edge to allow the passage of liquids along a main direction, and a closure device according to claim 1, coupled to the edge.

* * * * *